US006123532A

United States Patent [19]

Lauth et al.

[11] Patent Number: 6,123,532

[45] Date of Patent: Sep. 26, 2000

[54] VANE PUMP HAVING A PRESSURE PLATE WHICH IS CONCAVE WHEN UNLOADED

[75] Inventors: Hans-Jürgen Lauth, Neu Anspach; Thomas Nied-Menninger, Usingen, both of Germany

[73] Assignee: Luk Fahrzeug—Hydraulik GmbH & Co. KG, Germany

[21] Appl. No.: 09/202,514

[22] PCT Filed: Apr. 9, 1998

[86] PCT No.: PCT/EP98/02082

§ 371 Date: Dec. 24, 1998

§ 102(e) Date: Dec. 24, 1998

[87] PCT Pub. No.: WO98/46884

PCT Pub. Date: Oct. 22, 1998

[30] Foreign Application Priority Data

Apr. 15, 1997 [DE] Germany ..... 197 15 650

[51] Int. Cl.[7] ..... F04C 2/344

[52] U.S. Cl. ..... 418/132; 418/133

[58] Field of Search ..... 418/132, 133; 29/888.025

[56] References Cited

U.S. PATENT DOCUMENTS

| | | | |
|---|---|---|---|
| 2,544,988 | 3/1951 | Gardiner et al. | 418/133 |
| 3,019,737 | 2/1962 | Prasse . | |
| 3,096,720 | 7/1963 | Younger | 418/133 |
| 3,695,791 | 10/1972 | Brundage | 418/131 |
| 3,752,609 | 8/1973 | Niemiec et al. | 418/132 |

FOREIGN PATENT DOCUMENTS

| | | | |
|---|---|---|---|
| 2607444 | 9/1976 | Germany . | |
| 3303247 | 8/1983 | Germany . | |
| 274658 | 6/1970 | Russian Federation | 418/133 |
| 1538537 | 1/1979 | United Kingdom . | |
| 1553794 | 10/1979 | United Kingdom . | |

*Primary Examiner*—John J. Vrablik

*Attorney, Agent, or Firm*—Ostrolenk, Faber, Gerb & Soffen, LLP

[57] ABSTRACT

A vane pump is proposed which has a rotor which accommodates a number of vanes that can move in the radial direction, has a cam ring which surrounds the rotor and forms at least one suction region and one pressure region, and has at least one pressure plate, which forms a lateral boundary surface of the suction and pressure regions and, when the vane pump is operating, is loaded by pressure on its side facing away from the suction and pressure regions, the pump being defined in that that surface (17; 19) of the pressure plate (13; 15) which faces the rotor (5) is designed to be concave—when there is no pressure in the vane pump (1).

6 Claims, 1 Drawing Sheet

VANE PUMP HAVING A PRESSURE PLATE WHICH IS CONCAVE WHEN UNLOADED

BACKGROUND TO THE INVENTION

The invention relates to a vane pump with movable vanes and more particularly to a pressure plate on the pump.

Vane pumps of the type addressed here are known. They are used, for example, to provide a fluid for a power steering system in a motor vehicle. They have a pump unit which comprises a cam ring and a rotor which is rotatably mounted in the latter. Said rotor is provided with slots which run radially with respect to the axis of rotation and in which vanes are mounted such that they can move in the radial direction. During the rotation of the rotor in the interior of the cam ring, spaces which become larger and smaller are formed by the vanes, so that at least one each of a suction region and a pressure region are produced. Provided on at least one side of the pump unit is a pressure plate, which forms a lateral boundary surface for the suction and pressure regions. When the pump is operating, the pressure plate is pressed against the pump unit, which sharply increases the wear. In order to counteract this, an appropriate clearance between the cam ring and rotor is provided when the pump is being assembled, as a result of which the volumetric efficiency is often not adequate.

U.S. Pat. No. 3,695,791 discloses a vane pump in which a domed pressure plate produced from a bimetal is used. The pressure plate is installed with such a bias that a predetermined spacing remains between the pressure plate and the rotor and such that the pressure plate is clamped flat between the housing and the rotor. The bimetal function of the sealing washer is intended to maintain this spacing during the operation of the pump. Should the pressure plate be bent under a pressure arising during the operation of the pump, then if the fluid to be delivered heats up, the bending is cancelled out, since the bimetal is correspondingly heated and counteracts the deflection caused by the pressure forces, in that the pressure plate snaps back. It has been shown that, in the case of the known pump, an adequate volumetric efficiency cannot be ensured in every case.

SUMMARY OF THE INVENTION

It is therefore the object of the invention to provide a vane pump which does not have this disadvantage.

In order to achieve this object, a vane pump which according to the invention is proposed. The pump is defined in that that surface of the pressure plate which faces the pump unit, that is that side of the pressure plate which faces the rotor, the vanes, the cam ring and the suction and pressure regions, is designed to be concave when there is no pressure in the pump. When the pressure plate is not under load, that is to say at low pressure (for example during straight-ahead travel, when no steering is being carried out), an adequate spacing in relation to the rotor and the vanes is provided, so that at low pressure the oil friction in the gap, and hence the mechanical losses, are low. If then, during the operation of the pump, a higher pressure acts on the pressure plate on the side facing away from the pump unit, said pressure plate will be bent, so that the gap between the vanes, the rotor and the pressure plate is reduced. This therefore results in a very high volumetric efficiency. In addition, the pressure plate rests flat on the lateral surface of the cam ring, so that under high pressure, pressing of the edges and a correspondingly high loading of the pressure plate and of the cam ring, said loading bringing about wear, are avoided.

Preference is given to an exemplary embodiment of the pump which is defined in that a pressure plate, which is correspondingly designed to be concave, is provided on each side of the rotor or of the pump unit, the concave side of the pressure plate facing the pump unit. In the case of a configuration of this type, optimal adaptation of the pressure plates to the operating pressure is possible on both sides. In the event of the pressure plates bending, caused when the pump is operating under high pressure, the gaps between vanes and the two plates are reduced to a minimum, so that a very high volumetric efficiency is established. At the same time, pressing of the edges on both sides of the cam ring under high pressure, and hence overloading of the pressure plates, is avoided.

BRIEF DESCRIPTION OF THE DRAWINGS

The invention will be explained in more detail below with reference to a drawing, in which.

DESCRIPTION OF A PREFERRED EMBODIMENT

Vane pumps of the type addressed here are in principle known, so that their construction and functioning will not be gone into in detail. A pump for a power-steering system will be assumed here by way of example.

Figure 1:
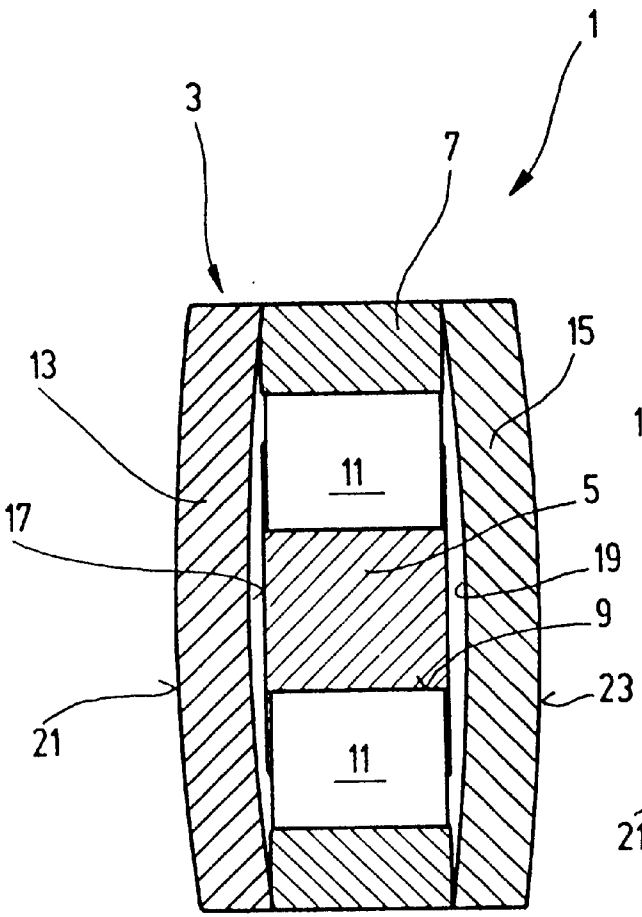
FIG. 1 shows a part section through a vane pump under low pressure.

The part section, reproduced in FIG. 1, through the vane pump 1 shows a pump unit 3, which comprises a rotor 5 and a cam ring 7 surrounding this. Machined into the rotor 5 are slots 9 running in the radial direction, into which vanes 11 which can move in the radial direction are inserted. The inner contour of the cam ring 7 is not circular, but is of approximately elliptical design, so that the vanes 11 are moved in and out during a rotation of the rotor. In the process, part spaces are formed, which increase and decrease in size during a revolution of the rotor, so that at least one suction region and one pressure region are produced. A first pressure plate 13 is provided on one side of the pump unit 3. On the other side, the pump unit may rest against a flat housing surface. It can be seen from FIG. 1 that, in the case of the exemplary embodiment illustrated here, a second pressure plate 15 is provided. That surface of the first pressure plate 13 which faces the pump unit 3 is designed to be concave, as is that surface 19 of the second pressure plate 15 which faces the pump unit 3. In the operating state which is reproduced in FIG. 1, the pressure plates 13 and 15 rest virtually only by way of their outer edges on the lateral boundary surfaces of the cam ring 7. The pressure provided on those sides of the pressure plates 13, 15 which face away from the rotor 5 is low (for example "idling pressure") or zero, so that the loading on the outer edges of the pressure plates is low.

In principle, it is possible to design the pressure plates 13 and 15 such that only their surfaces 17 and 19 which face the pump unit 3 are of domed design. However, FIG. 1 illustrates an embodiment in which the inner and outer surfaces of the pressure plates 13 and 15 run parallel to each other. The outer surface 21 of the first pressure plate 13 is thus designed to be convex in the operating state which is shown here, as is the outer surface 23 of the second pressure plate 15.

During the operation of the vane pump 1, a high pressure force, such as arises during the actuation of the steering, acts on the outer surfaces 21 and 23 of the pressure plates 13 and 15. This force is indicated in FIG. 2 by arrows.

Figure 2:
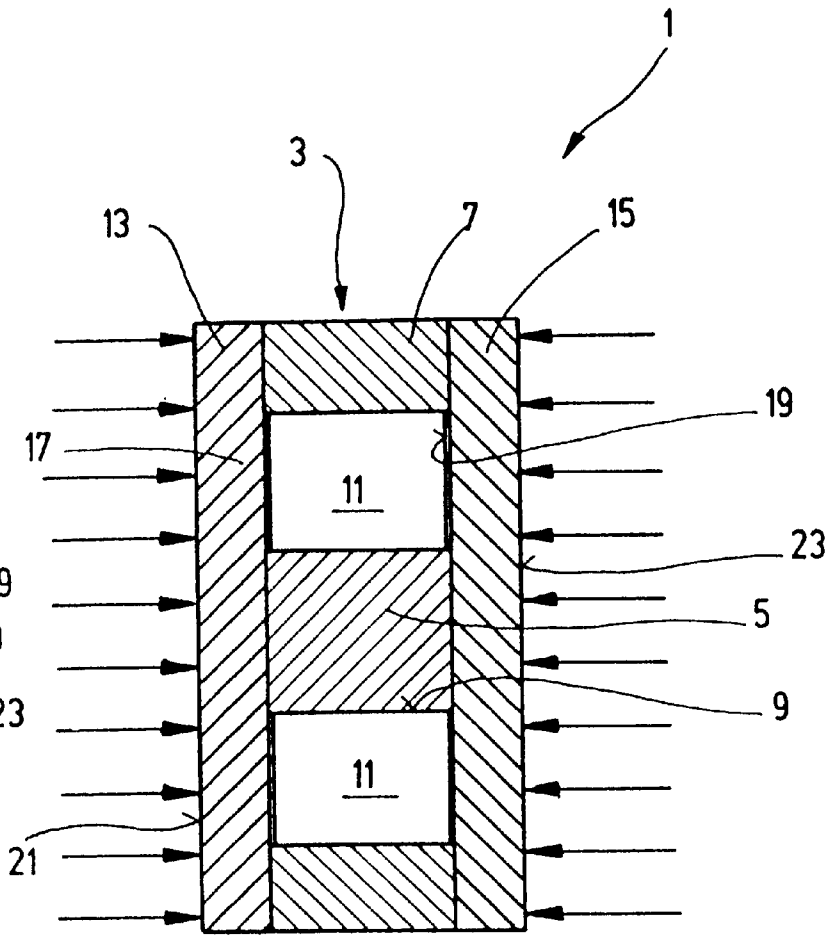
FIG. 2 shows a part section through the vane pump illustrated in FIG. 1 under operating pressure (high pressure when the steering is being activated).

In the operating state which is illustrated in FIG. 2, the pressure plates 13 and 15 are bent under the given pressure forces, so that their surfaces 17 and 19 facing the pump unit 3 run parallel to the side surfaces of the pump unit 3, and form a lateral boundary surface for the suction and pressure regions of the pump unit 3.

From FIG. 2, in which the same parts as in FIG. 1 are provided with the same reference numerals, it can be seen that, under operating pressure, the pressure plates 13 and 15 rest flat on the pump unit 3, that is to say in particular on the lateral boundary surfaces of the cam ring 7. The pressure plates 13, 15 are loaded only with relatively small forces on account of the surface pressure.

The width of the cam ring 7 corresponds approximately to the width of the rotor 5. Normally, the cam ring is 15 to 30 $\mu$m broader than the rotor. The vanes 11 are somewhat narrower than the rotor 5 and the cam ring 7. Because of the fact that the pressure plates 13 and 15 rest flat on the pump unit 3 when under pressure, only extremely narrow gaps arise in the region of the vanes 11, so that a very high volumetric efficiency results under high pressure. This means that the part spaces divided off by the vanes are sealed off from one another in an optimum fashion, so that the medium delivered by the vane pump is able to flow back from the pressure region to the suction region only to an extremely small extent. At a low pressure, as was assumed in FIG. 1, that is to say, for example, under idling pressure, a relatively poor volumetric efficiency results. This is of reduced significance in this operating state, since the load that is coupled to the pump, the power-steering system, is not active in this operating state (straight-ahead travel without steering movement). Because of the gaps between the vanes and pressure plates, the result is a lower viscous friction between rotor, vanes and the pressure plates, so that the friction power, that is to say the drive losses, is also lower.

By comparing the arrangement of the surfaces 17 and 19 of the pressure plates 13 and 15 in FIGS. 1 and 2, it readily becomes clear that the gap provided in the unpressurized state between the surfaces 17 and 19, in relation to the lateral edges of the vanes 11, is reduced to a minimum during the operation of the vane pump, the pressure plates 13 and 15 resting flat on the outside of the cam ring 7 in the operating state. The surfaces 17 and 19 of the pressure plates 13 and 15 are configured such that, under operating pressure, these form a plane which runs parallel to the lateral surfaces of the pump unit 3.

The bending of the pressure plates 13, 15 takes place continuously, that is to say uniformly with a rising pressure applied to that surface of the pressure plates which faces away from the rotor 5. Since the pressure plates 13, 15 are installed so that they can move freely and without bias, abrupt bending is avoided. It is also particularly advantageous that the pressure plates 13, 15 are loaded with a surface pressure at a high pressure of the fluid to be delivered, and are loaded with an edge pressure at a low pressure of the fluid. In both cases, the forces acting on the pressure plates are relatively low.

In order to be able to grind the surfaces 17 and 19 so to speak in the shape of a lens in a simple way, the pressure plates 13 and 15 are shaped geometrically such that, following grinding, flat surfaces result under pressure, which correspond to a straight bending line in the sectional illustration according to FIG. 2.

It is also possible, during the machining of the surfaces 17 and 19, to load the pressure plates 13 and 15 in such a way that, first of all, a convex contour results, which is then removed evenly. A straight bending line then results when the pressure plates 13 and 15 are loaded during the production of the surfaces 17 and 19.

Overall, therefore, it can be seen that the pressure plates may remain unloaded during production, while a concave surface is being machined out, or can be pre-curved, in order then to machine out a flat surface under defined preloading forces, this surface assuming a concave curvature in the unloaded state.

Deformation of the pressure plates 13 and 15 under operating pressure can be defined by the selection of the material for the pressure plates and by predefining a specific plate thickness. It is therefore possible to predefine a defined behavior of the pressure plates in the operating state.

The curvature of the surfaces 17 and 19 can be selected such that, in the unloaded state, the deepest point of the pressure plates 13 and 15 is set back with respect to an imaginary plane by 10 $\mu$m to 40 $\mu$m, preferably by 15 $\mu$m to 30 $\mu$m.

Following all that has been said, it becomes clear that a specific behavior of the pressure plates 13 and 15 can be set in a simple way. In the case of a low pressure on that outer surface 21 and 23 of the pressure plates 13 and 15 which faces away from the pump unit 3 (FIG. 1), only a low friction results as the result of the so-called entrained oil flow between the rotor 5 and the surfaces 17 and 19, because of the large clearance between rotor/vanes and pressure plates. In the case of a high pressure acting on the outer surfaces 21 and 23 (FIG. 2), the pressure plates 13, 15 deform, as explained with reference to FIG. 2, so that a high volumetric efficiency or, respectively, a low leakage is established. In this case, the surfaces 17 and 19 of the pressure plates 13 and 15 rest continuously and uniformly and increasingly flat on the outer surface of the cam ring 7, high edge pressures being avoided on account of the smooth contact. The contact area between the pressure plates and the cam ring therefore increases with increasing external pressure. The surface load can therefore be kept approximately constant. It is therefore possible to reduce the wear and the loading on the vane pump 1 to a minimum.

What is claimed is:

1. A vane pump comprising a rotor rotatable around an axis, a plurality of vanes supported in the rotor to be movable in the radial direction, a cam ring around the rotor and the vanes and forming at least one suction region and one pressure region at the rotor; the rotor and cam ring having opposite lateral sides, a pressure plate at at least one lateral side of the rotor, the pressure plate being shaped and positioned for forming a lateral boundary for the rotor at the suction and the pressure regions and at the cam ring, the pressure plate having an inward side which faces toward and forms a lateral boundary surface of both the suction and the pressure regions of the rotor and at the cam ring, and the pressure plate has an opposite outward side facing away from the suction and pressure region, wherein when the vane pump is operating for drawing fluid into the suction region and pumping it from the pressure region, the outward side of the pressure plate is loaded by pressure;

the pressure plate being shaped so that the inward side facing the rotor is concave when there is no pressure in the vane pump and the pressure plate is of such material which is related to the pressure to which the outward side of the pressure plate is exposed that the pressure plate is flattened toward the rotor to reduce the concavity of the concave inward side of the pressure plate when the rotor is rotating and the outward side of the pressure plate is loaded by pressure.

2. The vane pump of claim 1, wherein the curvature of the inward side of the pressure plate is selected and the material of the pressure plate is selected so that the pressure plate is deformed so that the inner side is virtually flat when the vane pump is operating and the pressure plate is loaded by pressure on the outward side.

3. The vane pump of claim 1, wherein the outward and inward sides of the pressure plate run essentially parallel.

4. The vane pump of claim 1, wherein the cam ring and the rotor are of equal lateral width, whereby the pressure plate is flattened against the rotor and the cam ring when the outward side of the pressure plate is loaded by pressure.

5. The vane pump of claim 1, further comprising a second one of the pressure plates on the opposite lateral side of the rotor and also having an inward side which is concave toward the rotor when the outward side of the plate is not loaded by pressure.

6. The vane pump of claim 5, wherein the cam ring and the rotor are of equal lateral width, whereby the pressure plates are flattened against the rotor and the cam ring when the outward sides of the pressure plates are loaded by pressure.

* * * * *